US006234367B1

(12) United States Patent
McCallister

(10) Patent No.: US 6,234,367 B1
(45) Date of Patent: May 22, 2001

(54) DEVICE FOR BENDING A CAP BRIM

(76) Inventor: Robert A. McCallister, 1909 Pawnee Dr., Olathe, KS (US) 66062

( * ) Notice: Subject to any disclaimer, the term of this patent is extended or adjusted under 35 U.S.C. 154(b) by 0 days.

(21) Appl. No.: 09/521,559

(22) Filed: Mar. 9, 2000

(51) Int. Cl.[7] ..... A42C 1/00
(52) U.S. Cl. ..... 223/25; 223/24
(58) Field of Search ..... 223/24, 25, 61, 223/15, 84

(56) References Cited

U.S. PATENT DOCUMENTS

| | | | | |
|---|---|---|---|---|
| 1,087,683 | * | 2/1914 | Pye | 223/25 |
| 2,393,632 | * | 1/1946 | Hartz | 223/61 |
| 3,459,347 | * | 8/1969 | Navara | 223/25 |
| 4,593,839 | * | 6/1986 | Vandoros | 223/61 |
| 4,805,782 | | 2/1989 | Hale et al. . | |
| 4,927,063 | | 5/1990 | Fricano . | |
| 5,094,369 | * | 3/1992 | Thompson | 223/25 |
| 5,163,589 | | 11/1992 | Biehl . | |
| 5,533,652 | | 7/1996 | Levin . | |
| 5,597,099 | * | 1/1997 | Sharp | 223/61 |
| 5,634,575 | | 6/1997 | Scharrenberg . | |
| 5,725,134 | | 3/1998 | Weltge . | |

* cited by examiner

*Primary Examiner*—Bibhu Mohanty
(74) *Attorney, Agent, or Firm*—Kenneth L Tolar

(57) ABSTRACT

A device for bending a cap brim includes first and second interconnected block members each having an S-shaped portion upwardly extending from the outer edge thereof that forms a groove on the upper surface for receiving a side edge of a cap brim. An externally threaded shaft extends from an inwardly facing side of one of the block members and is threadedly received within a threaded bore on the other block member whereby rotation of the shaft moves the block members toward each other. Accordingly, a user can bend a cap brim to a desired curvature by securing the brim within the block grooves and moving the blocks a select distance until the desired curvature is achieved.

2 Claims, 1 Drawing Sheet

DEVICE FOR BENDING A CAP BRIM

BACKGROUND OF THE INVENTION

The present invention relates to a device for quickly and easily bending a cap brim to a desired curvature.

DESCRIPTION OF THE PRIOR ART

A cap typically includes a forwardly projecting brim that initially has a generally flat orientation. In order to fit more comfortably on a wearer's head, the brim is manually bent to a desired curvature. Maintaining such curvature over a period of time is difficult in that the brim gradually reverts back to its original configuration. Furthermore, manually bending the brim to a symmetrical curvature is difficult. The present invention provides a device for bending a cap brim to a desired curvature.

Various cap bending devices exist in the prior art. For example, U.S. Pat. No. 5,725,134 issued to Weltge relates to a support device for a cap including a block of compressible, resilient material shaped generally to conform to the inside of the cap and sized somewhat larger than the cap. The support device is compressed, inserted into a cap and released to secure the device therein.

U.S. Pat. No. 5,634,575 issued to Scharrenberg relates to an apparatus and method of reforming cap visors. The device includes a substantially visor shaped upper member having a pair of retention plates thereon for retaining a cap brim. A pair of elongated devices are attached to the upper member which are grasped to bend the upper member and thus the cap brim.

U.S. Pat. No. 5,533,652 issued to Levin relates to a cap brim shaping, transport, storage and display device including a body portion extending downwardly on each side and terminating with an upwardly extending retention arm that forms a receiving area for a side edge of the cap brim. An elastic band extends over the top of the brim to bend the brim to a desired curvature.

U.S. Pat. No. 5,163,589 issued to Biehl relates to a cap press including a cylindrical base portion for stretching the body of the cap and a visor clamp with a pair of jaws operably connected to press the cap visor into a predetermined shape.

U.S. Pat. No. 4,927,063 issued to Fricano relates to a combination cap hanger and visor press including pivotally connected spring loaded gripping members adapted to receive a cap visor that are curved in a direction corresponding thereto.

U.S. Pat. No. 4,805,782 issued to Hale et al relates to a cap shaping and drying apparatus.

Although various devices for bending a cap brim exist in the prior art, most are cumbersome to operate. The present invention provides a pair of interconnected, spaced block members to which a cap brim is attached. The block members may be moved towards and away from each other to form a cap brim having a desired curvature.

SUMMARY OF THE INVENTION

The present invention relates to a device for bending a cap brim. The device comprises a pair of block members each having an S-shaped portion upwardly extending from an end thereof. The S-shaped portion forms a groove on the upper surface of the block to receive an edge of a cap brim. A first, movable block includes an elongated threaded shaft rotatably mounted thereto. The shaft threadedly engages an internally threaded bore on the other block member. A pair of guide rails extend from an inwardly facing side of the movable block, each slidably received within a passageway on the second block to maintain the blocks in alignment. One or more straps are attachable to the S-shaped portions and can be positioned above the cap brim to prevent the brim from being inadvertently displaced from the grooves. It is therefore an object of the present invention to provide a device which quickly and conveniently bends a cap brim to a desired curvature.

It is another object of the present invention to provide a device designed to form a symmetrical bend in a cap brim.

It is yet another object of the present invention to provide a device that can bend a cap brim with minimal effort. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
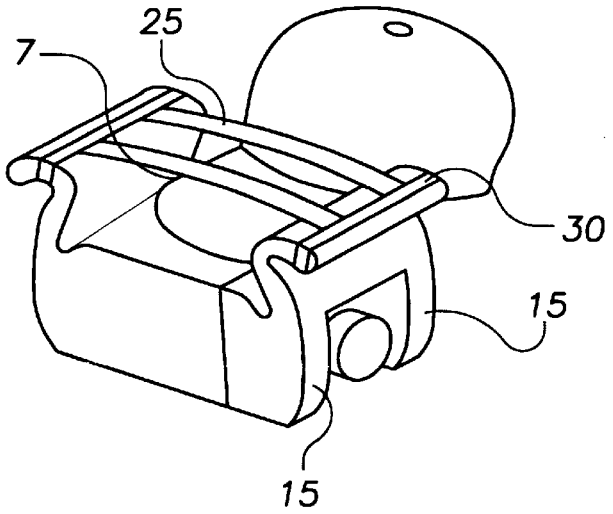
FIG. 1 is a perspective view of the present invention with a cap attached thereto.
Figure 2:
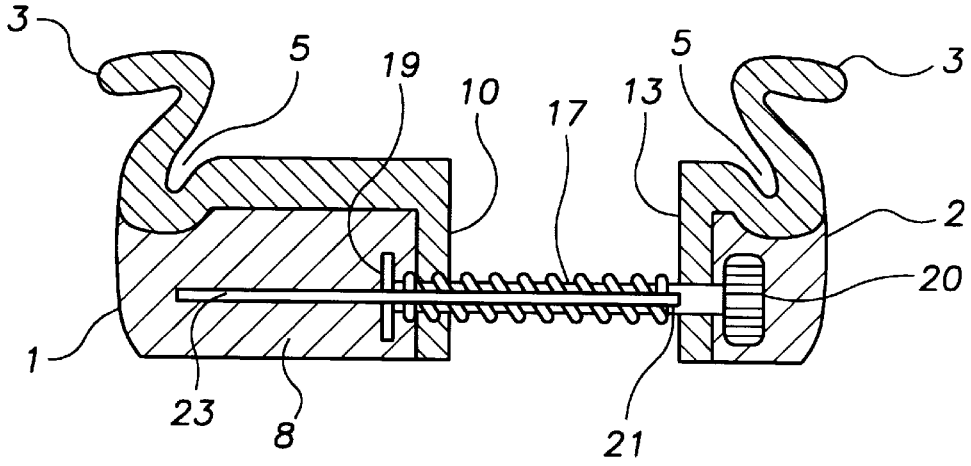
FIG. 2 is an enlarged, side cross-sectional view of the device in an expanded position.
Figure 3:
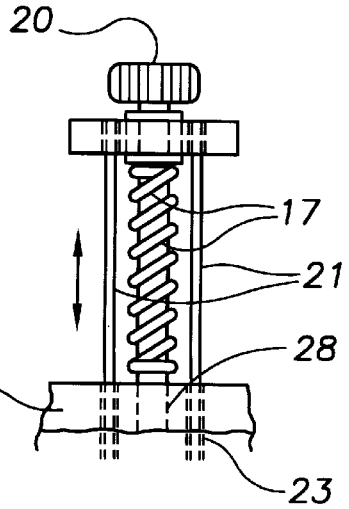
FIG. 3 is a top view of the threaded shaft and guide rails.

Referring now to FIGS. 1 through 3, the present invention relates a device for bending a cap brim to a desired curvature. The device includes a first fixed block 1 and a second interconnected movable block 2. Each block includes an upper surface with a substantially S-shaped portion 3 upwardly extending from an outer edge thereof. Each S-shaped portion forms a groove 5 on the upper surface of each block for receiving a side edge 7 of a cap brim as depicted in FIG. 1. The stationary block includes a hollow cavity 8 and an inwardly facing wall 10. The inwardly facing wall includes an internally threaded bore 28 that is in communication with the cavity.

The movable block includes a vertical inner wall 13 with a pair of spaced side walls 15 extending outwardly therefrom. The inner wall also includes a bore that is axially aligned with the threaded bore on the stationary block. Rotatably received within the bore is an elongated, externally threaded shaft 17. The shaft is also received within the threaded bore on the stationary block with a first end extending into the cavity. An end plate 19 is attached to the first end of the shaft to prevent the shaft from being unthreaded from the stationary block member. The opposing end of the shaft includes a knob 20 attached thereto positioned on the outwardly facing side of the inner wall and between the spaced side walls. Extending from the inwardly facing side of the inner wall are a pair of horizontal, parallel guide rails 21 diametrically positioned relative to the threaded shaft. Each guide rail is slidably received within an elongated passageway 23 within the stationary block member. The guide rails maintain a proper and consistent orientation of the block members as the device is extended and retracted.

The device also includes one or more elastomeric strap members 25 each secured at each end to a retaining band 30. Each retaining band may be wrapped about the upper end of one of the S-shaped portions with each strap disposed above the cap brim as depicted in FIG. 1. The retaining straps apply downward pressure to the cap brim to assist in maintaining the brim within the grooves.

To use the above described device, the blocks are spaced at a sufficient distance so that the opposing side edges of the cap brim can be tightly inserted within a corresponding groove on one of the block members. A user then grasps the knob and rotates the shaft in a predetermined direction to slide the movable block towards the stationary block member until the cap brim is bent to a desired curvature.

The block members are preferably constructed with plastic. However, as will be readily apparent to those skilled in the art, size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A device for bending a cap brim comprising:

a first block member having an outer edge with a groove formed thereon for receiving a side edge of a cap brim;

a second block member interconnected with said first block member, said second block member having an outer edge with a groove formed thereon for receiving an opposing side edge of a cap brim;

means for moving said first block member towards and away from said second block member to bend the cap brim to a desired curvature, said means including a rotatable threaded shaft extending from an inwardly facing side of said second block member and threadedly engaging said first block member whereby rotation of said shaft in a predetermined direction advances said first block member toward said second block member, and rotation of said shaft in an opposite direction displaces said movable block from said stationary block;

a knob attached to a first end of said shaft which is grasped by a user to rotate said shaft;

a plurality of guide rails extending from the inwardly facing side of said second block member, each of said guide rails slidably received within a designated passageway within said first block member to maintain a consistent orientation of block members as said first block member is moved relative to the second block member.

2. A device according to claim 1 further comprising a plurality of retaining straps attachable to each of said block members and positionable above a cap brim resting thereon to retain the cap brim within said grooves.

* * * * *